US011726511B2

(12) United States Patent
Ogura

(10) Patent No.: US 11,726,511 B2
(45) Date of Patent: Aug. 15, 2023

(54) CONSTANT VOLTAGE CIRCUIT THAT CAUSES DIFFERENT OPERATION CURRENTS DEPENDING ON OPERATION MODES

(71) Applicants: KABUSHIKI KAISHA TOSHIBA, Tokyo (JP); TOSHIBA ELECTRONIC DEVICES & STORAGE CORPORATION, Tokyo (JP)

(72) Inventor: Akio Ogura, Yokohama Kanagawa (JP)

(73) Assignees: Kabushiki Kaisha Toshiba, Tokyo (JP); Toshiba Electronic Devices & Storage Corporation, Tokyo (JP)

( * ) Notice: Subject to any disclaimer, the term of this patent is extended or adjusted under 35 U.S.C. 154(b) by 196 days.

(21) Appl. No.: 17/198,165

(22) Filed: Mar. 10, 2021

(65) Prior Publication Data

US 2022/0050486 A1 Feb. 17, 2022

(30) Foreign Application Priority Data

Aug. 12, 2020 (JP) ..... 2020-136142

(51) Int. Cl.
*G05F 1/56* (2006.01)

(52) U.S. Cl.
CPC ..... *G05F 1/56* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 5,686,821 A * 11/1997 Brokaw ..... G05F 1/575 323/280
5,689,460 A 11/1997 Ooishi
6,809,577 B2 10/2004 Matsumoto et al.
8,981,745 B2 * 3/2015 Price ..... G05F 1/56 323/284

(Continued)

FOREIGN PATENT DOCUMENTS

CN 200979668 Y 11/2007
CN 102331806 A 1/2012

(Continued)

*Primary Examiner* — Thienvu V Tran
*Assistant Examiner* — Nusrat Quddus
(74) *Attorney, Agent, or Firm* — Kim & Stewart LLP

(57) ABSTRACT

According to one embodiment, a constant voltage circuit includes: a first gain stage that outputting a first voltage amplifying a difference voltage between a divided voltage of an output voltage and a reference voltage; a second gain stage outputting a second voltage amplifying the first voltage; a second transistor, one end of which is coupled to the input voltage terminal, and other end of which is coupled to an output voltage terminal, controlling the output voltage to be constant in accordance with the second voltage applied to the gate; and a first circuit selecting one of a first operation mode and a second operation mode. When the first operation mode is selected, a first current flows to the first node, and when the second operation mode is selected, a second current flows to the first node.

14 Claims, 8 Drawing Sheets

(56) References Cited

U.S. PATENT DOCUMENTS

| | | | | |
|---|---|---|---|---|
| 9,235,225 | B2 * | 1/2016 | Price | G05F 1/575 |
| 9,684,325 | B1 * | 6/2017 | Rasmus | G05F 1/575 |
| 9,829,356 | B1 * | 11/2017 | Smith | G01D 18/008 |
| 9,874,889 | B1 * | 1/2018 | Zhao | G05F 1/575 |
| 9,893,607 | B1 * | 2/2018 | Wan | H02M 1/36 |
| 10,164,593 | B1 * | 12/2018 | Harwalkar | H03G 3/3068 |
| 10,192,590 | B1 * | 1/2019 | Fifield | G05F 1/595 |
| 11,545,901 | B1 * | 1/2023 | Zeng | H02M 1/0032 |
| 2009/0121693 | A1 | 5/2009 | Noda | |
| 2012/0001605 | A1 | 1/2012 | Sakurai et al. | |
| 2013/0069607 | A1 | 3/2013 | Suzuki | |
| 2013/0141068 | A1 * | 6/2013 | Kay | H02M 1/14 323/282 |
| 2013/0314063 | A1 * | 11/2013 | Napravnik | G05F 1/56 323/273 |
| 2014/0247028 | A1 * | 9/2014 | Pons | G05F 1/575 323/281 |
| 2014/0266105 | A1 * | 9/2014 | Li | G05F 1/565 323/280 |
| 2015/0346749 | A1 * | 12/2015 | Bernardon | G05F 1/575 323/274 |
| 2016/0342171 | A1 * | 11/2016 | Tomioka | G05F 3/262 |
| 2017/0205840 | A1 | 7/2017 | Ogura | |
| 2018/0024580 | A1 * | 1/2018 | Coimbra | G05F 1/563 323/280 |
| 2018/0292851 | A1 * | 10/2018 | Mahajan | G05F 1/575 |
| 2020/0272184 | A1 * | 8/2020 | Petenyi | G05F 1/565 |
| 2020/0366194 | A1 * | 11/2020 | Tsai | H02M 3/158 |
| 2023/0015014 | A1 * | 1/2023 | Ogura | G05F 1/575 |
| 2023/0018036 | A1 * | 1/2023 | Saha | G05F 1/575 |

FOREIGN PATENT DOCUMENTS

| | | | |
|---|---|---|---|
| CN | 102999075 | A | 3/2013 |
| JP | H11-41041 | A | 2/1999 |
| JP | 2004-70813 | A | 3/2004 |
| JP | 3705842 | B2 | 10/2005 |
| JP | 2007-179123 | A | 7/2007 |
| JP | 2007-280025 | A | 10/2007 |
| JP | 2007-304716 | A | 11/2007 |
| JP | 2015-533443 | A | 11/2015 |
| JP | 2017-126259 | A | 7/2017 |

* cited by examiner

| VIN | ENABLE | VOUT | MS | Operation mode |
|---|---|---|---|---|
| — | L | — | — | OFF |
| VIN≦(VOUT−VA) | H | VOUT | L | Test mode |
| VIN>(VOUT−VA) | H | VOUT | H | Normal mode |

| VIN | ENABLE | VOUT | MS | Operation mode |
|---|---|---|---|---|
| — | L | — | — | OFF |
| VIN≦(H−VB) | H | VOUT | L | Test mode |
| VIN>(H−VB) | H | VOUT | H | Normal mode |

CONSTANT VOLTAGE CIRCUIT THAT CAUSES DIFFERENT OPERATION CURRENTS DEPENDING ON OPERATION MODES

CROSS-REFERENCE TO RELATED APPLICATIONS

This application is based upon and claims the benefit of priority from Japanese Patent Application No. 2020-136142, filed Aug. 12, 2020, the entire contents of which are incorporated herein by reference.

FIELD

Embodiments described herein relate generally to a constant voltage circuit.

BACKGROUND

A linear regulator is known as one type of constant voltage circuit.

DETAILED DESCRIPTION

Figure 1:
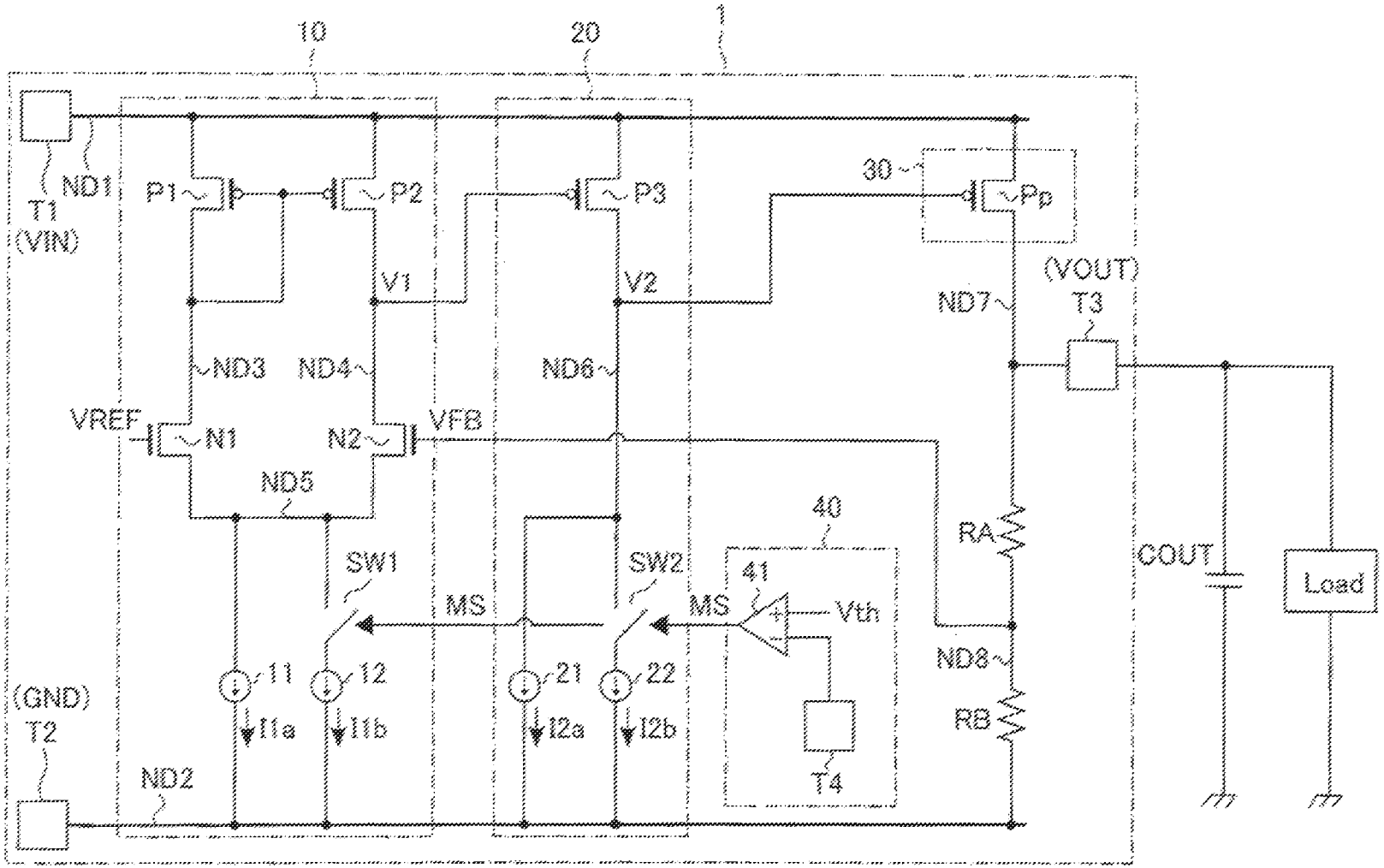
FIG. 1 is a circuit diagram of a constant voltage circuit according to a first embodiment.

In general, according to one embodiment, a constant voltage circuit includes a first gain stage that outputs a first voltage amplifying a difference voltage between a divided voltage of an output voltage and a reference voltage; a second gain stage that includes a first transistor, to a gate of which the first voltage is applied, one end being coupled to an input voltage terminal, and other end being coupled to a first node, the second gain stage outputting from the first node a second voltage amplifying the first voltage; a second transistor, to a gate of which the second voltage is applied, one end of which is coupled to the input voltage terminal, and other end of which is coupled to an output voltage terminal, the second transistor controlling the output voltage that is output from the output voltage terminal to be constant in accordance with the second voltage; and a first circuit that selects one of a first operation mode and a second operation mode. When the first operation mode is selected, a first current flows from the first transistor to the first node, and when the second operation mode is selected, a second current larger than the first current flows from the first transistor to the first node.

Hereinafter, embodiments will be described with reference to the accompanying drawings. In the description below, components having substantially the same functions and configurations will be denoted by the same reference symbols, and duplicate descriptions may be omitted. Further, all descriptions of a certain embodiment apply to the other embodiments unless explicitly or obviously excluded.

It is not essential that function blocks be separated from each other as in the examples described below. For example, a function may be performed by a function block different from a function block described as performing the function in the following examples. Further, a function block may be divided into smaller function sub-blocks. The embodiments are not limited by the function blocks specifying them.

In the present specification and claims, the description of a first component being "coupled" to a second component can refer either to a state where the first component is coupled directly to the second component or to a state where the first component is coupled to the second component via a component that is either always conductive or selectively becomes conductive.

1. First Embodiment

A constant voltage circuit according to a first embodiment will be described. In the present embodiment, a linear regulator will be described as an example of the constant voltage circuit.

The constant voltage circuit of the present embodiment has a test mode and a normal mode as operation modes. The test mode is selected when the constant voltage circuit is tested, for example, in amass production test (a shipping inspection). The normal mode is selected when the constant voltage circuit is used in a normal manner. For example, the constant voltage circuit in the normal mode exhibits superior power supply rejection ratio (PSRR) characteristics or superior output transient response characteristics to a rapid load variation (hereinafter also referred to as "responsiveness") to when it is in the test mode. On the other hand, the constant voltage circuit in the test mode exhibits superior stability against parasitic inductance and the like, i.e., superior oscillation resistance, to when it is in the normal mode.

1.1 Configuration

First, a circuit configuration of the constant voltage circuit will be described with reference to FIG. 1. FIG. 1 is a circuit diagram showing an example of the circuit configuration of the constant voltage circuit. In the description below, when a source and a drain of a transistor need not be specified, either one of them will be referred to as "one end of the transistor", with the other being referred to as "the other end of the transistor".

As shown in FIG. 1, the constant voltage circuit 1 includes an input voltage terminal T1, a reference voltage terminal T2, an output voltage terminal T3, a signal terminal T4, a first gain stage 10, a second gain stage 20, an output stage 30, a mode selection circuit 40, and resistance elements RA and RB.

The constant voltage circuit 1 functions as an amplifier including the first gain stage 10, the second gain stage 20, and the output stage 30.

The input voltage terminal T1 is coupled to a node ND1 (hereinafter also referred to as "power-supply voltage line"), and an input voltage VIN is externally applied to the input voltage terminal T1.

The reference voltage terminal T2 is coupled to a node ND2 (hereinafter also referred to as "ground voltage line"). The reference voltage terminal T2 may be grounded, or a ground voltage VSS may be applied to the reference voltage terminal T2.

The output voltage terminal T3 is coupled to a node ND7, and an output voltage VOUT is output from the output voltage terminal T3. For example, when the constant voltage circuit 1 is used, a capacitive element COUT is coupled between the output voltage terminal T3 and a load that is externally coupled to the constant voltage circuit 1. The capacitive element COUT functions as an output capacitor, and, for example, suppresses fluctuations, oscillations, etc. of the output voltage VOUT caused by a variation of the load coupled to the output voltage terminal T3, a parasitic inductance developed between the constant voltage circuit 1 and the load, or the like. For example, one electrode of the capacitive element COUT is coupled to the output voltage terminal T3, and the other electrode is grounded (coupled to the ground voltage line).

The signal terminal T4 functions as a signal terminal for an externally received test mode selection signal. For example, when the test mode selection signal is at a high ("H") level, in other words, when an "H" level voltage is applied to the signal terminal T4, the constant voltage circuit 1 selects the test mode. When the test mode selection signal is at a low ("L") level, in other words, when an "L" level voltage is applied to the signal terminal T4, the constant voltage circuit 1 selects the normal mode.

The resistance elements RA and RB function as a voltage-dividing circuit that divides the output voltage VOUT. One end of the resistance element RA is coupled to the node ND7, and the other end is coupled to a node ND8. One end of the resistance element RB is coupled to the node ND8, and the other end is coupled to the node ND2. When a voltage applied to the node ND8 is denoted by VFB and resistance values of the resistance elements RA and RB are denoted by rA and rB, respectively, the output voltage VOUT and the voltage VFB has the following relationship: $VOUT=VFB\times(1+rA/rB)$. That is, the voltage VFB is a divided voltage obtained by dividing the output voltage VOUT.

The first gain stage 10 is a differential amplifier circuit. The first gain stage 10 compares the reference voltage VREF with the voltage VFB and outputs a voltage according to a difference therebetween (namely, a voltage obtained by amplifying a difference voltage therebetween) to the second gain stage 20. The first gain stage 10 includes P-channel MOSFETs (Metal Oxide Semiconductor Field Effect Transistors) (hereinafter also referred to as "PMOS transistors") P1 and P2, N-channel MOSFETs (hereinafter also referred to as "NMOS transistors") N1 and N2, current sources 11 and 12, and a switch circuit SW1.

One end of the PMOS transistor P1 is coupled to the node ND1, and the other end and a gate are coupled to a node ND3.

One end of the PMOS transistor P2 is coupled to the node ND1, the other end is coupled to a node ND4, and a gate is coupled to the node ND3. That is, the PMOS transistors P1 and P2 form a current mirror.

One end of the NMOS transistor N1 is coupled to the node ND3, and the other end is coupled to a node ND5. The reference voltage VREF is applied to a gate of the NMOS transistor N1. The reference voltage VREF is constant irrespective of a temperature or the input voltage VIN.

One end of the NMOS transistor N2 is coupled to the node ND4, and the other end is coupled to the node ND5. The voltage VFB is applied to a gate of the NMOS transistor N2.

One end of the current source 11 is coupled to the node ND5, and the other end is coupled to the node ND2. A current I1*a* flows from the current source 11 to the node ND2.

One end of the switch circuit SW1 is coupled to the node ND5, and the other end is coupled to one end of the current source 12. The switch circuit SW1 operates in response to a mode signal MS received from the mode selection circuit 40. For example, the mode signal MS is at an "H" level in the normal mode, and at an "L" level in the test mode. For example, the switch circuit SW1 is in an ON state (a connected state) when receiving the "H" level mode signal MS, and in an OFF state (a non-connected state) when receiving the "L" level mode signal MS.

The other end of the current source 12 is coupled to the node ND2. A current I1*b* flows from the current source 12 to the node ND2. Thus, in the test mode an operating current I1*a* flows through the first gain stage 10 (differential amplifier circuit), and in the normal mode an operating current (I1*a*+I1*b*) flows through the first gain stage 10. The operating current (I1*a*+I1*b*) is larger than the operating current I1*a*. For this reason, the second gain stage 20 that follows the first gain stage 10 can be driven more rapidly in the normal mode than in the test mode.

The second gain stage 20 amplifies an output voltage of the first gain stage 10 and outputs the amplified voltage to the output stage 30. The second gain stage 20 includes a PMOS transistor P3, current sources 21 and 22, and a switch circuit SW2.

One end of the PMOS transistor P3 is coupled to the node ND1, and the other end is coupled to a node ND6. A gate of the PMOS transistor P3 is coupled to the node ND4. In other words, an output voltage V1 of the first gain stage 10 is applied to the gate of the PMOS transistor P3.

One end of the current source 21 is coupled to the node ND6, and the other end is coupled to the node ND2. A current I2*a* flows from the current source 21 to the node ND2.

One end of the switch circuit SW2 is coupled to the node ND6, and the other end is coupled to one end of the current source 22. The switch circuit SW2 operates in response to the mode signal MS received from the mode selection circuit 40. For example, the switch circuit SW2 is in an ON state when receiving the "H" level mode signal MS, and in an OFF state when receiving the "L" level mode signal MS.

The other end of the current source 22 is coupled to the node ND2. A current I2*b* flows from the current source 22 to the node ND2. Thus, in the test mode an operating current I2*a* flows through the second gain stage 20, and in the normal mode an operating current (I2*a*+I2*b*) flows through the second gain stage 20. The operating current (I2*a*+I2*b*) is larger than the operating current I2*a*. For this reason, the output stage 30 that follows the second gain stage 20 can be driven more rapidly in the normal mode than in the test mode.

The output stage 30 controls the output voltage VOUT of the constant voltage circuit 1. The output stage 30 includes a PMOS transistor Pp.

One end of the PMOS transistor Pp is coupled to the node ND1, and the other end is coupled to the node ND7. A gate of the PMOS transistor Pp is coupled to the node ND6. In other words, an output voltage V2 of the second gain stage 20 is applied to the gate of the PMOS transistor Pp. The PMOS transistor Pp functions as an output driver of the constant voltage circuit 1. To make the output voltage VOUT constant, a gate voltage of the PMOS transistor Pp varies according to a variation of the output voltage VOUT, and an "on" resistance of the PMOS transistor Pp is regulated.

For example, when there is no voltage difference between the reference voltage VREF and the voltage VFB, namely VFB=VREF, the output voltage VOUT is expressed as VOUT=VREF×(1+rA/rB). This expression of the output voltage VOUT does not include either the term representing the input voltage VIN or the term representing a load current flowing into the load. That is, the output voltage VOUT can be kept constant even when the input voltage VIN and the load are varied.

The mode selection circuit 40 includes a comparator 41.

An inverting input terminal of the comparator 41 is coupled to the signal terminal T4. A threshold voltage Vth is input into a non-inverting input terminal of the comparator 41. The threshold voltage Vth is set to determine whether the voltage (test mode selection signal) of the signal terminal T4 is at the "H" level or at the "L" level. For example, the threshold voltage Vth is set to an intermediate voltage between the "L" level voltage and the "H" level voltage. The mode signal MS is output from an output terminal of the comparator 41. For example, when the "H" level voltage is applied to the signal terminal T4, that is, when the test mode is selected, the comparator 41 outputs the "L" level mode signal MS. When the "L" level voltage is applied to the signal terminal T4, that is, when the normal mode is selected, the comparator 41 outputs the "H" level mode signal MS.

1.2 Mode Selecting Operation

Figure 2:
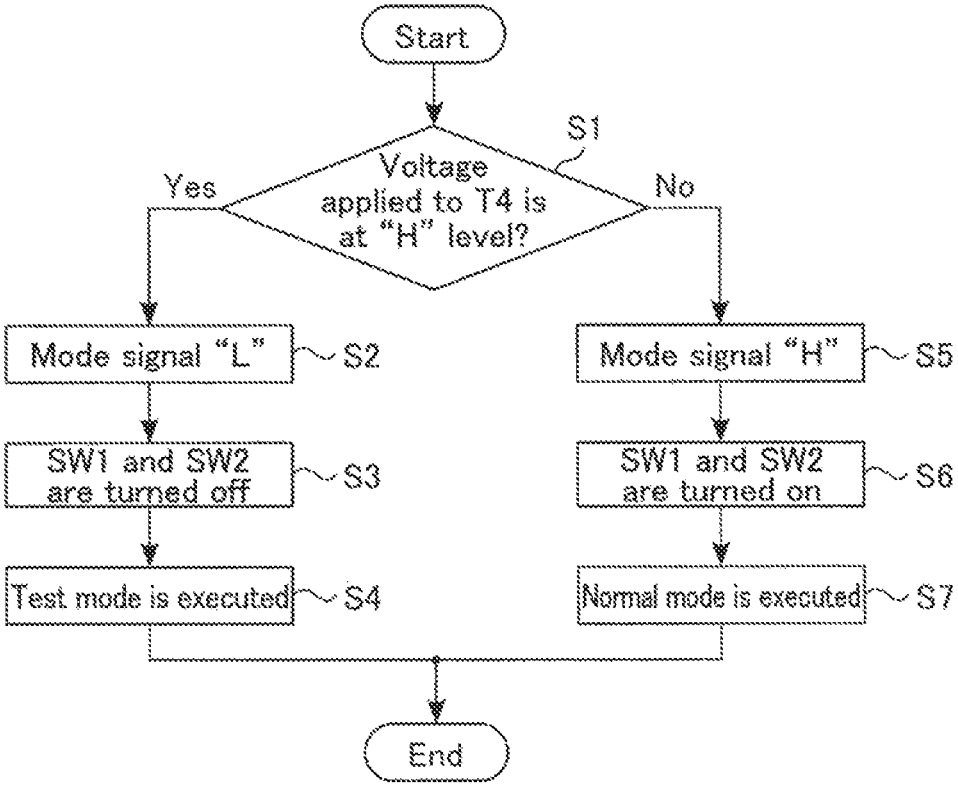
FIG. 2 is a flowchart illustrating a selecting operation of an operation mode of the constant voltage circuit according to the first embodiment.

Next, a mode selecting operation will be described with reference to FIG. 2. FIG. 2 is a flowchart illustrating the mode selecting operation.

As shown in FIG. 2, when the voltage (test mode selection signal) of the signal terminal T4 is at the "H" level (Yes in step S1), the mode selection circuit 40 outputs the "L" level mode signal MS (step S2). In other words, when the voltage applied to the inverting input terminal of the comparator 41 is equal to or higher than the threshold voltage Vth of the non-inverting input terminal, the comparator 41 outputs the "L" level voltage.

Upon receipt of the "L" level mode signal MS, the switch circuits SW1 and SW2 are turned off (step S3). As a result, the constant voltage circuit 1 operates in the test mode (step S4).

On the other hand, when the voltage of the signal terminal T4 is at the "L" level (No in step S1), the mode selection circuit 40 outputs the "H" level mode signal MS (step S5). In other words, when the voltage applied to the inverting input terminal is lower than the threshold voltage Vth of the non-inverting input terminal, the comparator 41 outputs the "H" level voltage.

Upon receipt of the "H" level mode signal MS, the switch circuits SW1 and SW2 are turned on (step S6). As a result, the constant voltage circuit 1 operates in the normal mode (step S7).

1.3 Influence of Parasitic Inductance in Testing Environment

Figure 3:
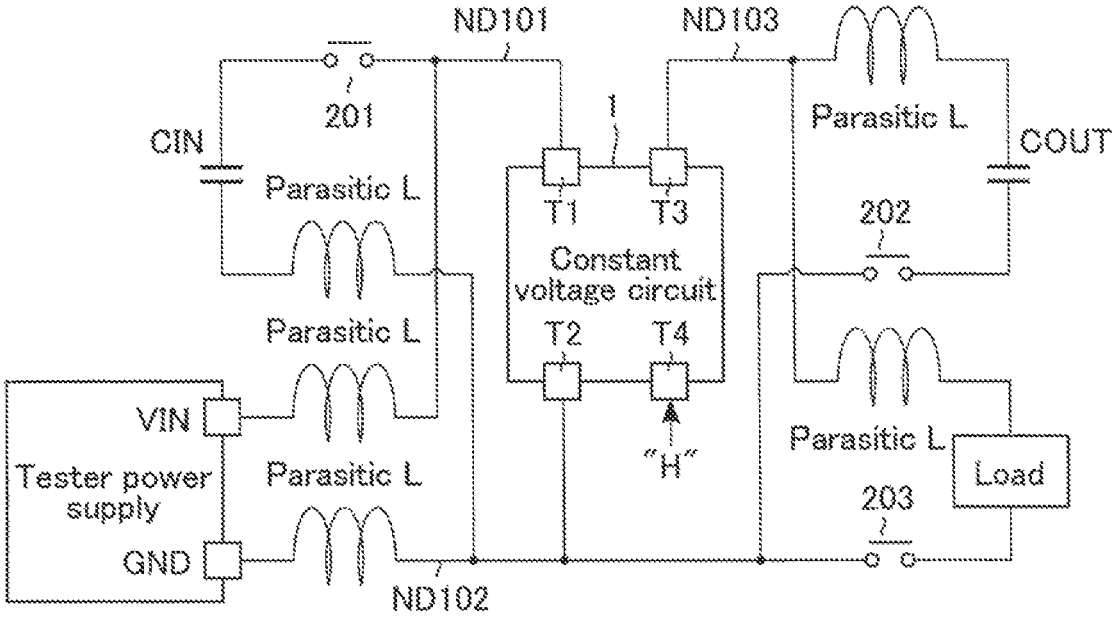
FIG. 3 is a schematic diagram illustrating an example of a test circuit used for testing of a constant voltage circuit.

Next, an influence of parasitic inductance in a testing environment of the constant voltage circuit 1 will be described with reference to FIG. 3. FIG. 3 is a schematic diagram showing an example of a test circuit used in testing the constant voltage circuit 1. For example, in a mass production test (a shipping inspection), one or more constant voltage circuits 1 are mounted on a jig (a test board). The jig is placed in a tester and the test is then conducted.

As shown in FIG. 3, the jig includes, for example, the constant voltage circuit 1, capacitive elements CIN and COUT, a load, and a plurality of relay circuits 201 to 203.

A VIN terminal of a tester power supply is coupled to a node ND101. A GND terminal of the tester power supply is coupled to a node ND102.

The input voltage terminal T1 of the constant voltage circuit 1 is coupled to the node ND101. The reference voltage terminal T2 of the constant voltage circuit 1 is coupled to the node ND102. The output voltage terminal T3 of the constant voltage circuit 1 is coupled to a node ND103. When the constant voltage circuit 1 is tested, an "H" level voltage is applied to the signal terminal T4 of the constant voltage circuit 1.

The capacitive elements CIN and COUT are used to decrease impedance between the VIN terminal and the GND terminal so as to stabilize the output voltage VOUT or so as to form a pole at a low-frequency range, thereby stabilizing a feedback path, and to prevent an unstable feedback operation in the constant voltage circuit 1.

One electrode of the capacitive element CIN is coupled to the node ND101 via the relay circuit 201. The other electrode of the capacitive element CIN is coupled to the node ND102.

One electrode of the capacitive element COUT is coupled to the node ND103. The other electrode of the capacitive element COUT is coupled to the node ND102 via the relay circuit 202.

One end of the load is coupled to the node ND103, and the other end is coupled to the node ND102 via the relay circuit 203.

The relay circuits 201 to 203 switch the connection of the capacitive element CIN, of the capacitive element COUT, and of the load, respectively. In some test items, the capacitive element CIN, the capacitive element COUT, or the load may be separated from the constant voltage circuit 1. For example, in measuring a consumption current of the constant voltage circuit 1, the relay circuit 201 for the capacitive element CIN and the relay circuit 202 for the capacitive element COUT are turned off in order to avoid a delay in testing time due to charge and discharge of the capacitive elements CIN and COUT, and to separate the consumption current from charging and discharging currents.

For example, in a mass production test, a plurality of constant voltage circuits 1 may be processed (measured) at the same time in order to shorten the testing time. If this is the case, the plurality of constant voltage circuits 1 are mounted on a jig together with corresponding capacitive elements CIN and corresponding capacitive elements COUT. On the jig, however, the capacitive elements CIN and COUT may not be provided near their corresponding constant voltage circuits 1 for layout reasons. Further, some measurements in the test may be performed with the capacitive elements CIN and COUT or the load separated from the constant voltage circuit 1. To this end, a relay may be provided between the constant voltage circuit 1 and each element. This may cause an interconnect between the constant voltage circuit 1 and each element to become relatively long. Similarly, an interconnect between the constant voltage circuit 1 and the tester power supply or the load may also become long. As a result, a relatively large parasitic inductance (hereinafter also referred to as "parasitic L") may occur in each interconnect (node). For example, parasitic inductance may occur between the VIN terminal of the tester power supply and the input voltage terminal T1 of the constant voltage circuit 1, between the reference voltage terminal T2 of the constant voltage circuit 1 and the GND terminal of the tester power supply, between the capacitive element CIN and the GND terminal of the tester power supply, between the output voltage terminal T3 of the constant voltage circuit 1 and the capacitive element COUT, and between the output voltage terminal T3 of the constant voltage circuit 1 and the load. The longer the interconnect becomes between the constant voltage circuit 1 and each element, the larger the parasitic inductance becomes.

1.4 Phase Characteristic

Figure 4:
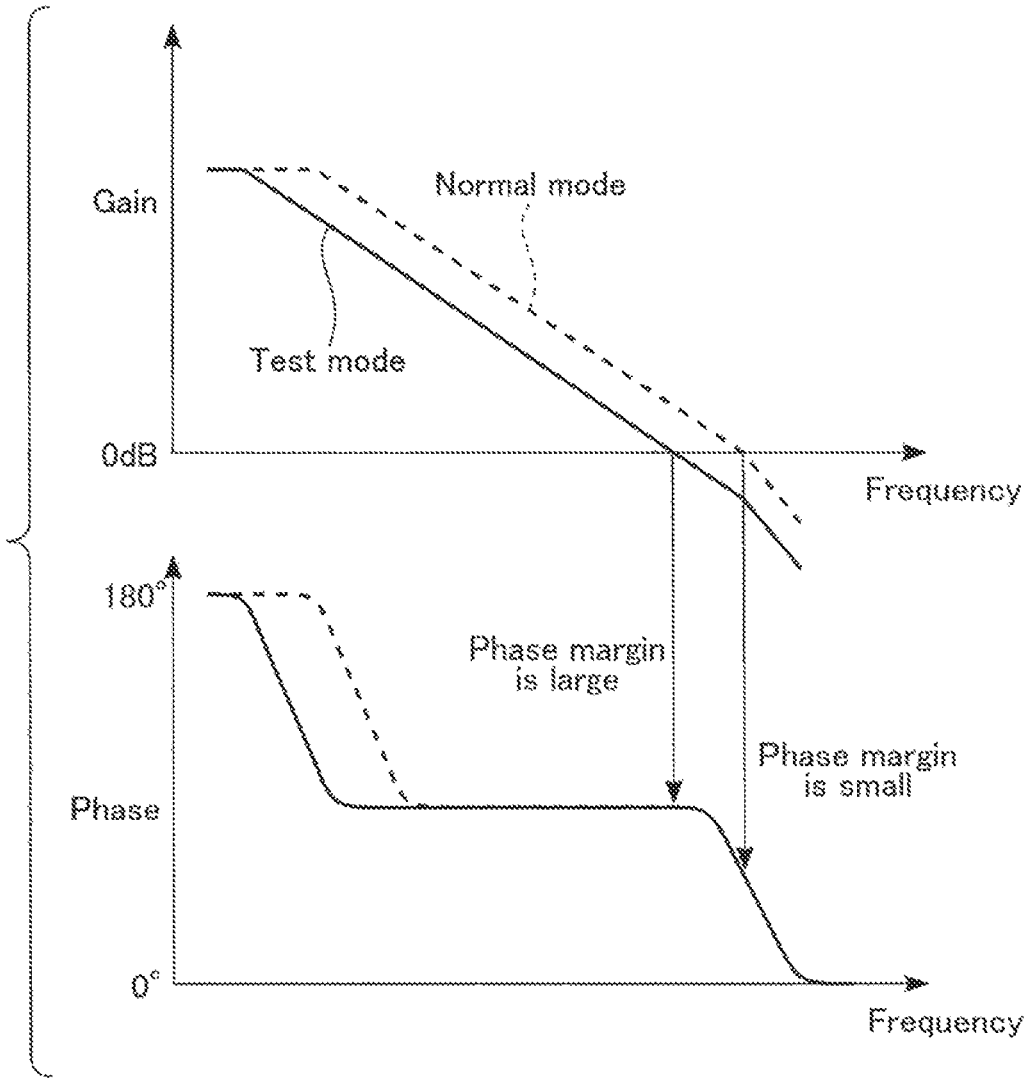
FIG. 4 is a set of graphs showing gain and phase frequency dependence in a test mode and a normal mode of the constant voltage circuit according to the first embodiment.

Next, the phase characteristic of the constant voltage circuit 1 will be described with reference to FIG. 4. FIG. 4 is a set of graphs (bode diagrams) showing a gain and a phase depend on frequency in the test mode and in the normal mode.

As shown in FIG. 4, in the test mode, no added current flows in the first gain stage 10 and in the second gain stage 20 (i.e., the current I1*b* does not flow in the first gain stage 10 and the current I2*b* does not flow in the second gain stage 20), as described above with reference to FIG. 1. This causes a first pole to be located on a lower frequency side in the test mode as compared to the normal mode. Thus, a gain starts to decrease at a lower frequency in the test mode than in the normal mode. As a result, a unity-gain frequency, a frequency at which a gain becomes 0 dB (1 time), is lower in the test mode than in the normal mode. The phase margin (a remaining phase from a phase of 180 degrees at a frequency at which a gain becomes 0 dB) is larger in the test mode than in the normal mode. In other words, the constant voltage circuit 1 exhibits superior stability (oscillation resistance) in the test mode than in the normal mode. Therefore, the constant voltage circuit 1 is less affected by parasitic inductance in the test mode than in the normal mode.

1.5 Advantageous Effect of Present Embodiment

The configuration according to the present embodiment can improve the reliability of a test on a constant voltage circuit. Details of this effect will be described below.

Devices in which a camera is installed, such as smartphones and drive recorders, have recently been increasing. This requires a linear regulator, which supplies a voltage to an image sensor used in the camera, to have a high PSRR and rapid responsiveness. To suppress oscillations of the linear regulator caused by parasitic inductance of interconnects coupled to the linear regulator, it is desirable to provide the capacitive elements CIN and COUT in the vicinity of the linear regulator. In amass production test (a shipping investigation), however, the capacitive elements CIN and COUT cannot be always provided near the linear regulator due to a restriction of the jig or other reasons. The stability (robustness) of the linear regulator against parasitic inductance, i.e., the oscillation resistance of the linear regulator, conflicts with the PSRR characteristics and the responsiveness of the linear regulator. That is, if the PSRR characteristics and the responsiveness are improved, the oscillation resistance deteriorates. Therefore, the reliability of the test on the linear regulator is lowered.

In contrast, the constant voltage circuit with the configuration according to the present embodiment has two operation modes, the test mode and the normal mode, and it includes a mode selection circuit. In the test mode, the operating currents in the first gain stage and the second gain stage can be made smaller than in the normal mode. Thus, when the constant voltage circuit is tested for shipping, for example, the test mode with high stability (oscillation resistance) can be used. Further, in a normal use of the constant voltage circuit, the normal mode that provides a high PSRR and rapid responsiveness can be used. Therefore, the reliability of the test on the constant voltage circuit having a high PSRR and rapid responsiveness can be improved.

2. Second Embodiment

Next, a second embodiment will be described. In the second embodiment, reference will be made to two configuration examples of the constant voltage circuit 1 that differ from the configuration according to the first embodiment. Hereinafter, the description will focus mainly on matters which differ from the first embodiment.

2.1 First Example

Figure 5:
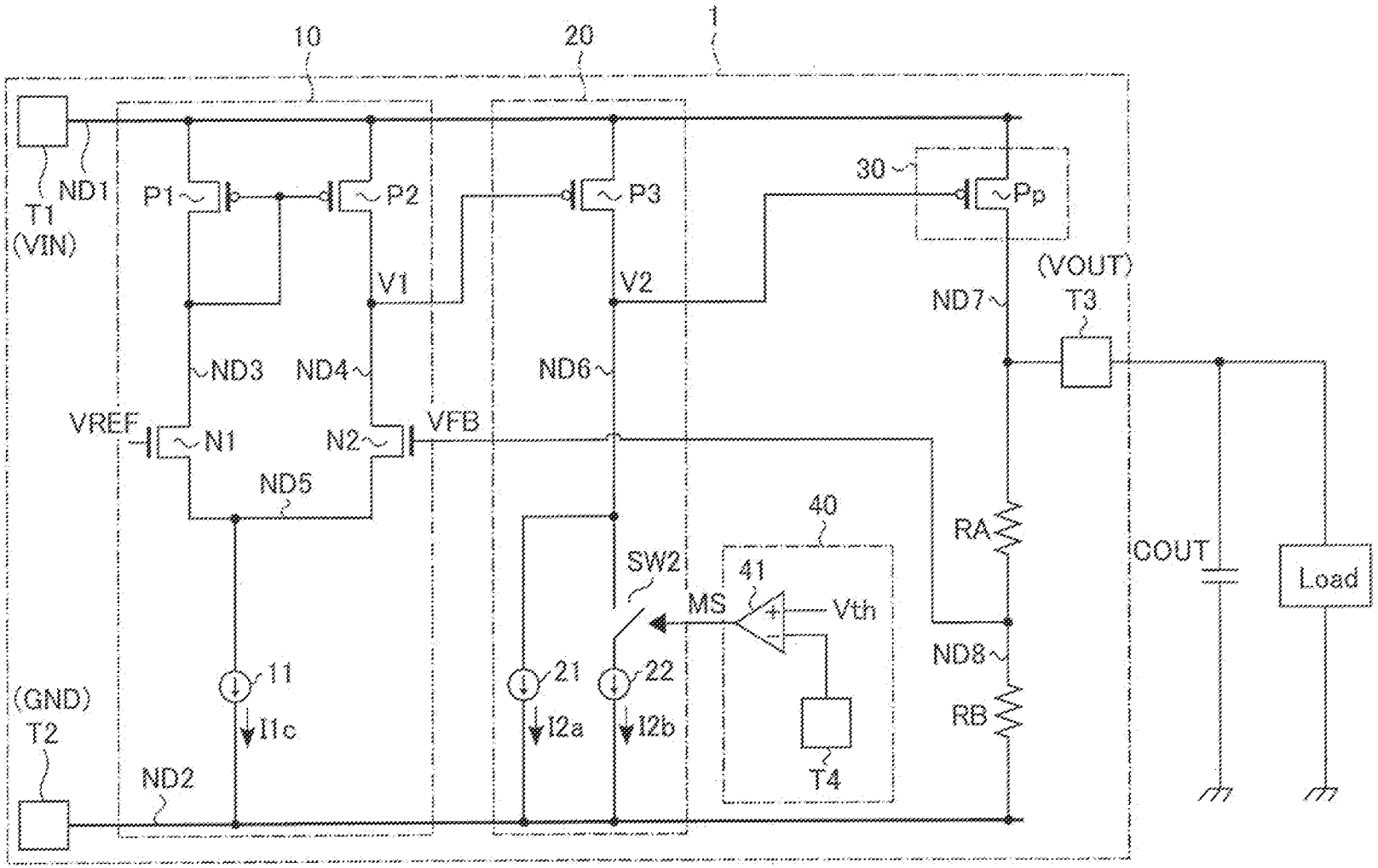
FIG. 5 is a circuit diagram of a constant voltage circuit according to a first example of a second embodiment.

First, a configuration of the constant voltage circuit 1 according to the first example will be described with reference to FIG. 5. FIG. 5 is a circuit diagram showing an example of a circuit configuration of the constant voltage circuit 1.

As shown in FIG. 5, the constant voltage circuit 1 in this example includes neither the current source 12 nor the switch circuit SW1 in the first gain stage 10. Other than this, the constant voltage circuit 1 in this example has the same configuration as that shown in FIG. 1 of the first embodiment.

A current I1*c* flows from the current source 11 to the node ND2. The current I1*c* may be the same as or different from the current I1*a* or I1*b* described in the first embodiment. Thus, an operating current I1*c* flows through the first gain stage 10 (differential amplifier circuit), irrespective of the operation mode.

2.2 Second Example

Figure 6:
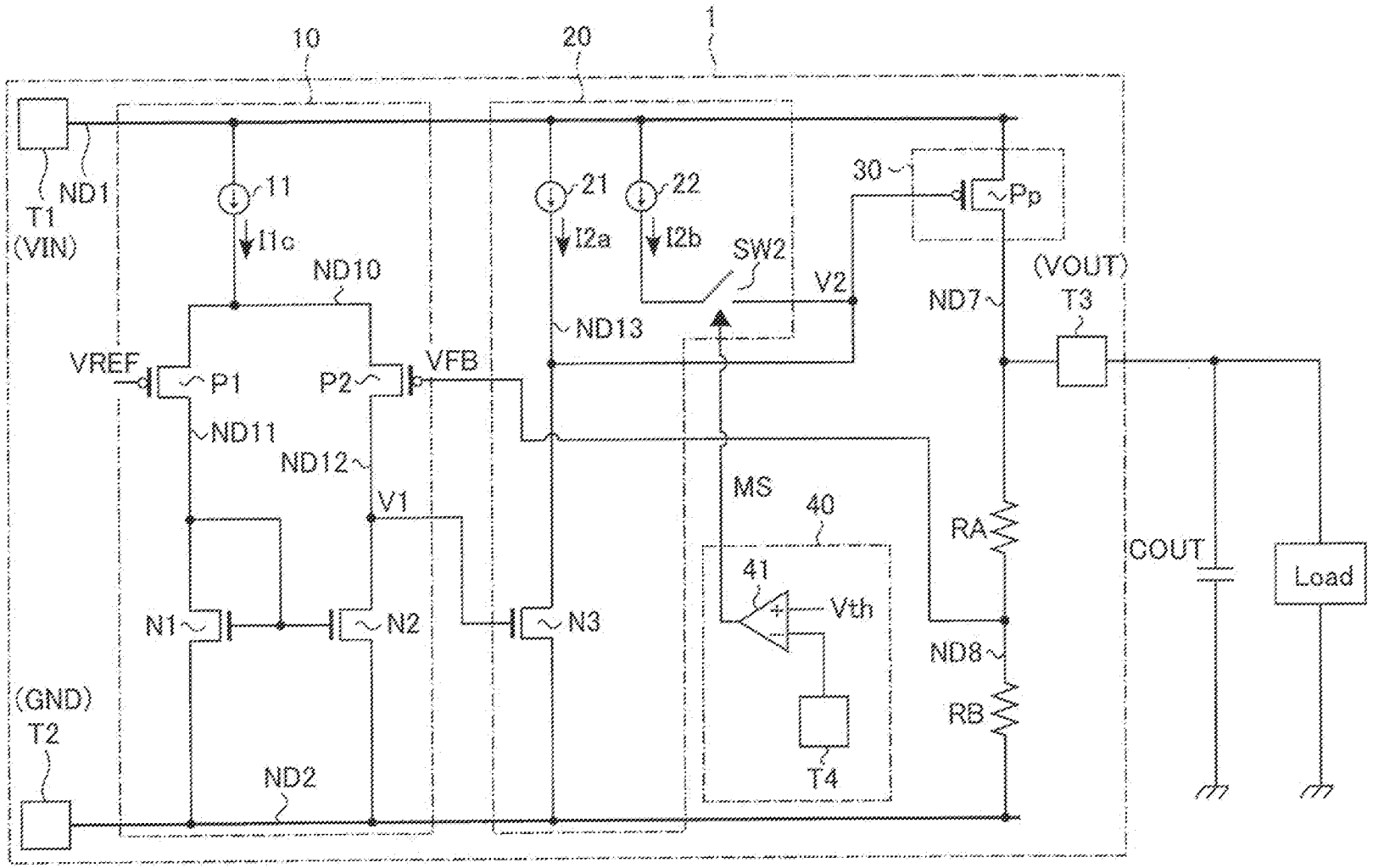
FIG. 6 is a circuit diagram of a constant voltage circuit according to a second example of the second embodiment.

Next, a configuration of the constant voltage circuit 1 according to the second example will be described with reference to FIG. 6. FIG. 6 is a circuit diagram showing an example of a circuit configuration of the constant voltage circuit 1.

As shown in FIG. 6, the constant voltage circuit 1 in this example uses a PMOS transistor for the input terminal of the first gain stage 10 and uses an NMOS transistor in the second gain stage 20.

The first gain stage 10 includes PMOS transistors P1 and P2, NMOS transistors N1 and N2, and a current source 11.

One end of the current source 11 is coupled to the node ND1, and the other end is coupled to the node ND10. A current I1*c* flows from the current source 11 to the node ND10.

One end of the PMOS transistor P1 is coupled to the node ND10, and the other end is coupled to the node ND11. The reference voltage VREF is applied to a gate of the PMOS transistor P1.

One end of the PMOS transistor P2 is coupled to the node ND10, and the other end is coupled to the node ND12. The voltage VFB is applied to a gate of the PMOS transistor P2.

One end of the NMOS transistor N1 and a gate of the NMOS transistor N1 are coupled to the node ND11, and the other end of the NMOS transistor N1 is coupled to the node ND2.

One end of the NMOS transistor N2 is coupled to the node ND12, the other end is coupled to the node ND2, and a gate of the NMOS transistor N2 is coupled to the node ND11. The NMOS transistors N1 and N2 form a current mirror.

The second gain stage 20 includes an NMOS transistor N3, current sources 21 and 22, and a switch circuit SW2.

One end of the current source 21 is coupled to the node ND1, and the other end is coupled to the node ND13. A current I2*a* flows from the current source 21 to the node ND13.

One end of the current source 22 is coupled to the node ND1, and the other end is coupled to one end of the switch circuit SW2. A current I2*b* flows from the current source 22 to the switch circuit SW2.

The other end of the switch circuit SW2 is coupled to the node ND13. The switch circuit SW2 operates in response to the mode signal MS received from the mode selection circuit 40. For example, the switch circuit SW2 is in an ON state when receiving the "H" level mode signal MS, and in an OFF state when receiving the "L" level mode signal MS.

One end of the NMOS transistor N3 is coupled to the node ND13, and the other end is coupled to the node ND2. A gate of the NMOS transistor N3 is coupled to the node ND12. In other words, the output voltage V1 of the first gain stage 10 is applied to the gate of the NMOS transistor N3.

A gate of a PMOS transistor Pp included in the output stage 30 is coupled to the node ND13. In other words, the output voltage V2 of the second gain stage 20 is applied to the gate of the PMOS transistor Pp.

Other than in the aforementioned aspects, the constant voltage circuit 1 in this example has the same configuration as that shown in FIG. 1 of the first embodiment.

2.3 Advantageous Effect of Present Embodiment

The same effect as the first embodiment can be achieved through the configuration according to the present embodiment.

In the second example, the first gain stage 10 may include the current source 12 and the switch circuit SW1 arranged in parallel with the current source 11, as in the first embodiment.

3. Third Embodiment

Next, a third embodiment will be described. In the third embodiment, two examples of the signal terminal T4 will be described. Hereinafter, the description will focus mainly on matters which differ from the first and second embodiments.

3.1 First Example

Figure 7:
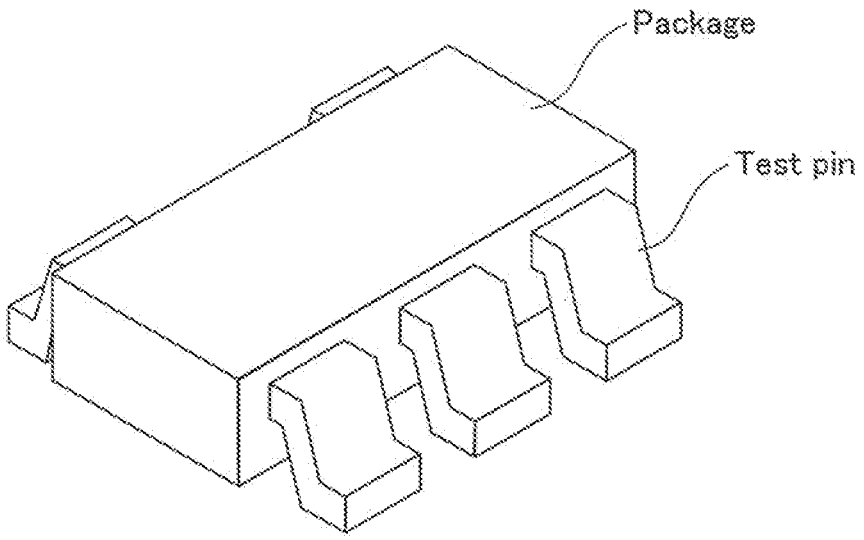
FIG. 7 is a perspective view of a package in which a constant voltage circuit according to a first example of a third embodiment is installed.

First, a first example will be described with reference to FIG. 7. FIG. 7 is a perspective view of a package including the constant voltage circuit 1.

As shown in FIG. 7, the package is provided with a test pin coupled to the signal terminal T4. A voltage is applied to the signal terminal T4 through the test pin. In a shipping inspection, for example, the constant voltage circuit 1 is tested in its final form (in a shipping form). The package can take any form, subject to the sole condition that one of the pins through which a voltage can be externally applied corresponds to the signal terminal T4.

3.2 Second Example

Figure 8:
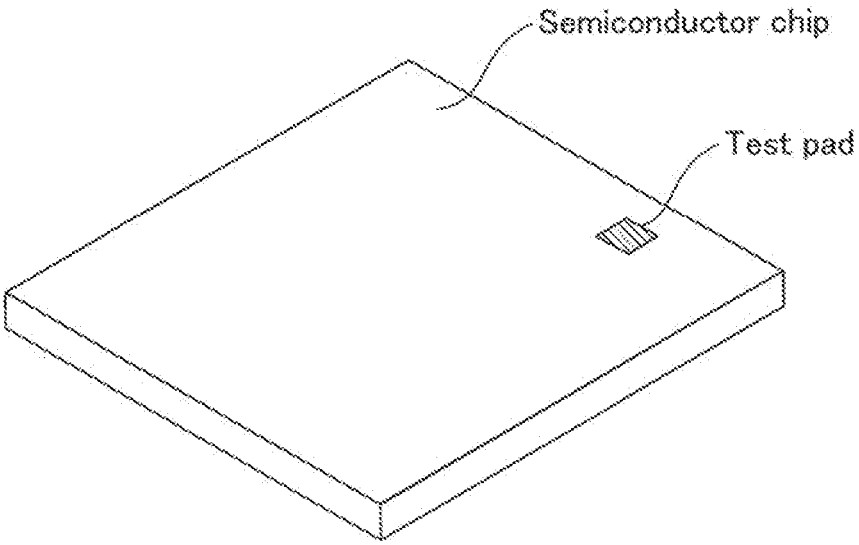
FIG. 8 is a perspective view of a semiconductor chip of the constant voltage circuit according to the first example of the third embodiment.

Next, a second example will be described with reference to FIG. 8. FIG. 8 is a perspective view of a semiconductor chip of the constant voltage circuit 1.

For example, the constant voltage circuit 1 may be tested prior to assembly in the process of manufacturing the constant voltage circuit 1. In this case, a test pad corresponding to the signal terminal T4 is provided on the surface of the semiconductor chip, as shown in FIG. 8. The test pad may not necessarily be bonded in the assembly process.

3.3 Advantageous Effect of Present Embodiment

The same effect as the first embodiment can be achieved through the configuration according to the present embodiment.

4. Fourth Embodiment

Next, a fourth embodiment will be described. In the fourth embodiment, two configuration examples of the mode selection circuit 40 that differ from the configuration according to the first embodiment will be described.

4.1 First Example

Figures 9, 10, 11:
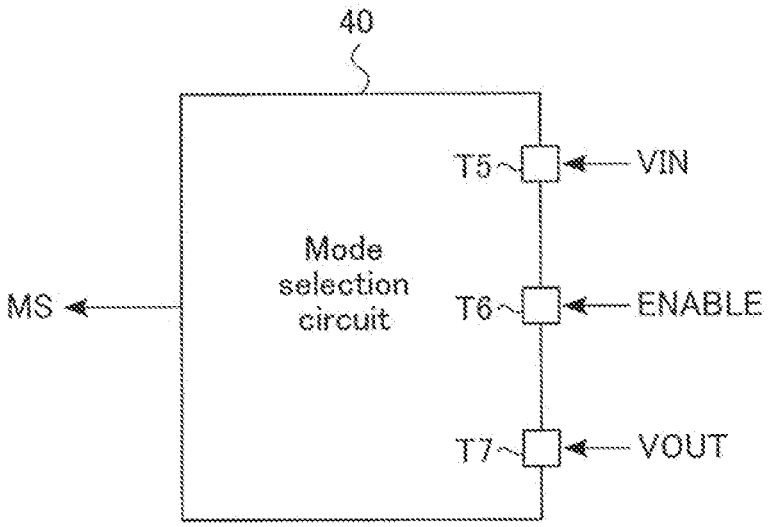
FIG. 9 is a block diagram of a mode selection circuit included in a constant voltage circuit according to a first example of a fourth embodiment.
FIG. 10 is a table showing an example of a relationship between operation modes and input signals of the mode selection circuit included in the constant voltage circuit according to the first example of the fourth embodiment.
FIG. 11 is a table showing an example of a relationship between operation modes and input signals of the mode selection circuit included in the constant voltage circuit according to the first example of the fourth embodiment.

First, a first example will be described with reference to FIGS. 9 to 11. FIG. 9 is a block diagram of the mode selection circuit 40. FIGS. 10 and 11 are tables each showing an example of the relationship between input signals of the mode selection circuit 40 and the operation mode. As shown in FIG. 9, the mode selection circuit 40 in this example includes a VIN input terminal T5, an enable signal input terminal T6, and a VOUT input terminal T7. The mode selection circuit 40 in this example selects the operation mode in accordance with a combination of three input signals (voltages).

The input voltage VIN applied to the input voltage terminal T1 is also applied to the VIN input terminal T5.

An externally received enable signal ENABLE is input to the enable signal input terminal T6. The enable signal ENABLE is, for example, a signal for turning the constant voltage circuit 1 to an enable state. For example, when the enable signal ENABLE is at the "H" level, the constant voltage circuit 1 is in an operational state (ON state).

The output voltage VOUT is applied to the VOUT input terminal T7.

First, a first example of the combination of the enable signal ENABLE and the voltages VIN and VOUT will be described.

As shown in FIG. 10, the mode selection circuit 40 may select the level of the mode signal MS in accordance with a voltage difference between the input voltage VIN and the output voltage VOUT.

More specifically, for example, when the enable signal ENABLE is at the "L" level, the constant voltage circuit 1 is in the OFF state.

In a state where the enable signal ENABLE is at the "H" level, when the voltage difference between the input voltage VIN and the output voltage VOUT is equal to or greater than a predetermined voltage VA, the mode selection circuit 40 outputs the "L" level mode signal MS that corresponds to the test mode. In other words, since the output voltage VOUT is constant, when the input voltage VIN is equal to or lower than a voltage of (VOUT−VA) within a range where the operation of the constant voltage circuit 1 is guaranteed, the test mode is selected.

On the other hand, when the voltage difference between the input voltage VIN and the output voltage VOUT is smaller than the predetermined voltage VA, the mode selection circuit 40 outputs the "H" level mode signal MS that corresponds to the normal mode. In other words, when the input voltage VIN is higher than the voltage of (VOUT−VA) within the range where the operation of the constant voltage circuit 1 is guaranteed, the normal mode is selected.

Next, a second example of the combination of the enable signal ENABLE and the voltages VIN and VOUT will be described.

As shown in FIG. 11, the mode selection circuit 40 may select the level of the mode signal MS in accordance with a voltage difference between the input voltage VIN and a voltage (H) of the "H" level enable signal ENABLE.

More specifically, for example, when the enable signal ENABLE is at the "L" level, the constant voltage circuit 1 is in the OFF state.

In a state where the enable signal ENABLE is at the "H" level, when the voltage difference between the input voltage VIN and the voltage (H) of the "H" level enable signal ENABLE is equal to or greater than a predetermined voltage VB, the mode selection circuit 40 outputs the "L" level mode signal MS that corresponds to the test mode. Thus, for example, if the voltage (H) of the "H" level enable signal ENABLE is constant, the test mode is selected when the input voltage VIN becomes equal to or lower than a voltage of (H−VB) within the range where the operation of the constant voltage circuit 1 is guaranteed. Further, if the input voltage VIN is constant, the test mode is selected when the voltage (H) of the "H" level enable signal ENABLE becomes equal to or higher than a voltage of (VIN+VB) within a voltage range where the enable signal ENABLE is determined as being at the "H" level.

On the other hand, when the voltage difference between the input voltage VIN and the voltage (H) of the "H" level enable signal ENABLE is smaller than the predetermined voltage VB, the mode selection circuit 40 outputs the "H" level mode signal MS that corresponds to the normal mode. Thus, for example, if the voltage (H) of the "H" level enable signal ENABLE is constant, the normal mode is selected when the input voltage VIN becomes higher than a voltage of (H−VB) within the range where the operation of the constant voltage circuit 1 is guaranteed. Further, if the input voltage VIN is constant, the normal mode is selected when the voltage (H) of the "H" level enable signal ENABLE becomes lower than a voltage of (VIN+VB) within the voltage range where the enable signal ENABLE is determined as being at the "H" level.

4.2 Second Example

Figure 12:
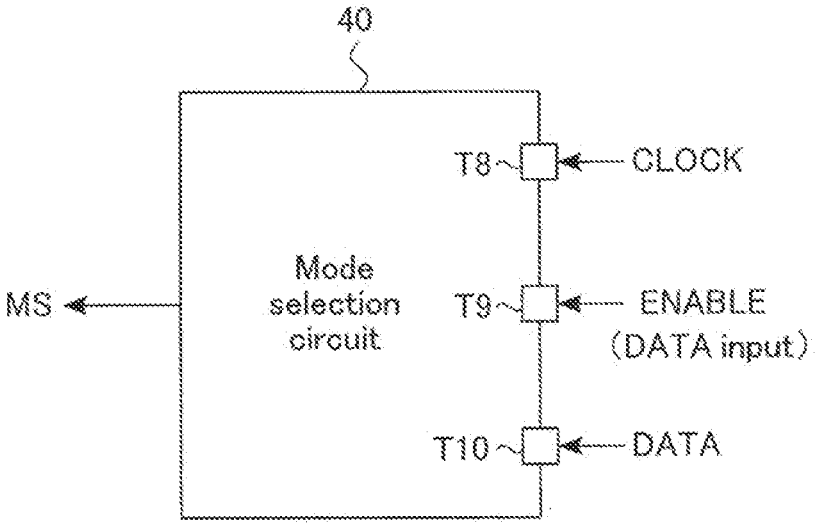
FIG. 12 is a block diagram of a mode selection circuit included in a constant voltage circuit according to a second example of the fourth embodiment.
Figure 13:
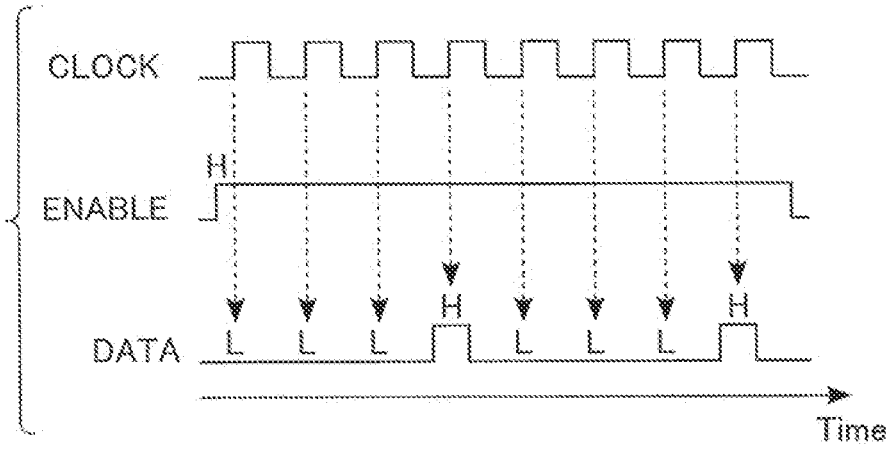
FIG. 13 is a timing chart of input signals of the mode selection circuit included in the constant voltage circuit according to the second example of the fourth embodiment.

Next, a second example will be described with reference to FIGS. 12 and 13. FIG. 12 is a block diagram of the mode selection circuit 40. FIG. 13 is a timing chart showing an example of a relationship between input signals of the mode selection circuit 40 and the operation mode.

In the second example, reference will be made to a case where the constant voltage circuit 1 conforms to a communication format such as a Serial Peripheral Interface (SPI) or an Inter-Integrated Circuit (I2C). The constant voltage circuit 1 includes a digital communication interface circuit that conforms to any standard. Thus, the constant voltage circuit 1 can be transitioned to the test mode by an external communication.

As shown in FIG. 12, the mode selection circuit 40 in this example includes a clock signal input terminal T8, an enable signal input terminal T9, and a DATA input terminal T10. The mode selection circuit 40 in this example selects the operation mode in accordance with a combination of three input signals (voltages).

An externally received clock signal CLOCK is input to the clock signal input terminal T8.

An externally received enable signal ENABLE is input to the enable signal input terminal T9. The enable signal ENABLE in this example is, for example, a signal for enabling input of data. For example, when the enable signal ENABLE is at the "H" level, the mode selection circuit 40 is in a state where data DATA can be received.

Externally received data DATA is input to the DATA input terminal T10.

Next, an example of the combination of the clock signal CLOCK, the enable signal ENABLE, and the data DATA will be described.

As shown in FIG. 13, for example, while the enable signal ENABLE is at the "H" level, the mode selection circuit 40 receives the data DATA at the timing when the clock signal CLOCK is switched from the "L" level to the "H" level. For example, when the received data DATA is "LLLHLLLH", the mode selection circuit 40 outputs the "L" level mode signal MS. That is, the constant voltage circuit 1 selects the test mode. Further, when the received data DATA is other than "LLLHLLLH", the mode selection circuit 40 outputs the "H" level mode signal MS. That is, the constant voltage circuit 1 selects the normal mode.

4.3 Advantageous Effect of Present Embodiment

The present embodiment is applicable to the first to third embodiments.

5. Modifications, Etc.

The foregoing embodiments are not limited to the above-described ones, and various modifications can be made.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A constant voltage circuit comprising:

a first gain stage that outputs a first voltage amplifying a difference voltage between a divided voltage of an output voltage and a reference voltage;

a second gain stage that includes a first transistor, to a gate of which the first voltage is applied, one end being coupled to an input voltage terminal, and other end being coupled to a first node, the second gain stage outputting from the first node a second voltage amplifying the first voltage;

a second transistor, to a gate of which the second voltage is applied, one end of which is coupled to the input voltage terminal, and other end of which is coupled to an output voltage terminal, the second transistor controlling the output voltage that is output from the output voltage terminal to be constant in accordance with the second voltage; and a first circuit that selects one of a first operation mode and a second operation mode, wherein when the first operation mode is selected, a first current flows from the first transistor to the first node, and when the second operation mode is selected, a second current larger than the first current flows from the first transistor to the first node, and when the first operation mode is selected, a third current flows through the first gain stage, and when the second operation mode is selected, a fourth current larger than the third current flows through the first gain stage.

2. The constant voltage circuit according to claim 1, wherein the first circuit includes a first terminal, and when a third voltage applied to the first terminal is equal to or higher than a threshold voltage, the first circuit selects the second operation mode.

3. A constant voltage circuit comprising:

a first gain stage that outputs a first voltage amplifying a difference voltage between a divided voltage of an output voltage and a reference voltage;

a second gain stage that includes a first transistor, to a gate of which the first voltage is applied, one end being coupled to an input voltage terminal, and other end being coupled to a first node, the second gain stage outputting from the first node a second voltage amplifying the first voltage;

a second transistor, to a gate of which the second voltage is applied, one end of which is coupled to the input voltage terminal, and other end of which is coupled to an output voltage terminal, the second transistor controlling the output voltage that is output from the output voltage terminal to be constant in accordance with the second voltage; and a first circuit that selects one of a first operation mode and a second operation mode, wherein when the first operation mode is selected, a first current flows from the first transistor to the first node, and when the second operation mode is selected, a second current larger than the first current flows from the first transistor to the first node, the first circuit includes a second terminal, a third terminal different from the second terminal, and a fourth terminal different from the second and third terminals, the first circuit selects the one of the first operation mode and the second operation mode based on an input voltage applied to the second terminal, a first signal applied to the third terminal, and the output voltage applied to the fourth terminal, and in a case where the first signal is at a first logical level, the first circuit selects the first operation mode when a first voltage difference between the output voltage and the input voltage is equal to or greater than a first threshold voltage, and selects the second operation mode when the first voltage difference is smaller than the first threshold voltage.

4. A constant voltage circuit comprising:

a first gain stage that outputs a first voltage amplifying a difference voltage between a divided voltage of an output voltage and a reference voltage;

a second gain stage that includes a first transistor, to a gate of which the first voltage is applied, one end being coupled to an input voltage terminal, and other end being coupled to a first node, the second gain stage outputting from the first node a second voltage amplifying the first voltage;

a second transistor, to a gate of which the second voltage is applied, one end of which is coupled to the input voltage terminal, and other end of which is coupled to an output voltage terminal, the second transistor controlling the output voltage that is output from the output voltage terminal to be constant in accordance with the second voltage; and a first circuit that selects one of a first operation mode and a second operation mode, wherein when the first operation mode is selected, a first current flows from the first transistor to the first node, and when the second operation mode is selected, a second current larger than the first current flows from the first transistor to the first node, the first circuit includes a second terminal, a third terminal different from the second terminal, and a fourth terminal different from the second and third terminals, the first circuit selects the one of the first operation mode and the second operation mode based on an input voltage applied to the second terminal, a first signal applied to the third terminal, and the output voltage applied to the fourth terminal, and in a case where the first signal is at a first logical level, the first circuit selects the first operation mode when the input voltage is equal to or lower than a second voltage difference between a fourth voltage of the first signal at the first logical level and a second threshold voltage, and selects the second operation mode when the input voltage is higher than the second voltage difference.

5. The constant voltage circuit according to claim 1, further comprising a communication interface circuit, wherein the first circuit selects the first operation mode or the second operation mode in accordance with a signal received via the communication interface circuit.

6. A constant voltage circuit comprising:

a first gain stage that outputs a first voltage amplifying a difference voltage between a divided voltage of an output voltage and a reference voltage;

a second gain stage that includes a first transistor, to a gate of which the first voltage is applied, one end being coupled to an input voltage terminal, and other end being coupled to a first node, the second gain stage outputting from the first node a second voltage amplifying the first voltage;

a second transistor, to a gate of which the second voltage is applied, one end of which is coupled to the input voltage terminal, and other end of which is coupled to an output voltage terminal, the second transistor controlling the output voltage that is output from the output voltage terminal to be constant in accordance with the second voltage; and a first circuit that selects one of a first operation mode and a second operation mode, wherein when the first operation mode is selected, a first current flows from the first transistor to the first node, and when the second operation mode is selected, a second current larger than the first current flows from the first transistor to the first node, and the second gain stage further includes:

a first current source, one end of which is coupled to the first node and other end of which is coupled to a ground voltage terminal;

a switch circuit, one end of which is coupled to the first node; and a second current source, one end of which is coupled to other end of the switch circuit, and other end of which is coupled to the ground voltage terminal, and the switch circuit is in an OFF state in the first operation mode and is in an ON state in the second operation mode.

7. The constant voltage circuit according to claim 1, further comprising:

a first resistor element, one end of which is coupled to the output voltage terminal and other end of which is coupled to a second node; and a second resistor element, one end of which is coupled to the second node and other end of which is coupled to a ground voltage terminal, wherein the divided voltage is applied to the second node.

8. The constant voltage circuit according to claim 1, wherein the first gain stage is a differential amplifier circuit.

9. The constant voltage circuit according to claim 1, wherein a phase margin is larger in the first operation mode than in the second operation mode.

10. The constant voltage circuit according to claim 1, wherein the first operation mode is a test mode.

11. A constant voltage circuit comprising:

a first gain stage that outputs a first voltage amplifying a difference voltage between a divided voltage of an output voltage and a reference voltage;

a second gain stage that includes a first transistor, to a gate of which the first voltage is applied, one end of which is coupled to a first node, and other end of which is coupled to a ground voltage terminal, the second gain stage outputting from the first node a second voltage amplifying the first voltage;

a second transistor, to a gate of which the second voltage is applied, one end of which is coupled to the input voltage terminal, and other end of which is coupled to an output voltage terminal, the second transistor controlling the output voltage that is output from the output voltage terminal to be constant in accordance with the second voltage; and a first circuit that selects one of a first operation mode and a second operation mode, wherein when the first operation mode is selected, a first current flows from the first node to the first transistor, and when the second operation mode is selected, a second current larger than the first current flows from the first node to the first transistor, and when the first operation mode is selected, a third current flows through the first gain stage, and when the second operation mode is selected, a fourth current larger than the third current flows through the first gain stage.

12. The constant voltage circuit according to claim 11, wherein the first circuit includes a first terminal, and when a third voltage applied to the first terminal is equal to or higher than a threshold voltage, the first circuit selects the second operation mode.

13. The constant voltage circuit according to claim 11, wherein the second gain stage further includes:

a first current source, one end of which is coupled to the input voltage terminal and other end of which is coupled to the first node;

a second current source, one end of which is coupled to the input voltage terminal; and a switch circuit, one end of which is coupled to other end of the second current source, and other end of which is coupled to the first node, and the switch circuit is in an OFF state in the first operation mode and is in an ON state in the second operation mode.

14. The constant voltage circuit according to claim 11, wherein the first operation mode is a test mode.

* * * * *